US005225002A

United States Patent [19]

Stafford et al.

[11] Patent Number: 5,225,002

[45] Date of Patent: Jul. 6, 1993

[54] PROCESS FOR DISSOLVING COKE OVEN DEPOSITS COMPRISING ATOMIZING A COMPOSITION CONTAINING N-METHYL-2-PYRROLIDONE INTO THE GAS LINES

[75] Inventors: Michael L. Stafford, Tomball; Gerald M. Nicholson, Houston, both of Tex.

[73] Assignee: Baker Hughes Incorporated, Houston, Tex.

[21] Appl. No.: 879,078

[22] Filed: May 1, 1992

Related U.S. Application Data

[63] Continuation of Ser. No. 564,895, Aug. 9, 1990, abandoned.

[51] Int. Cl.[5] ..... B08B 9/02; C11P 7/50

[52] U.S. Cl. ..... 134/22.14; 134/22.11; 134/22.19; 134/39; 134/40; 134/42; 252/162; 252/170; 252/174.21; 252/174.23; 252/542

[58] Field of Search ..... 134/22.11, 22.14, 22.19, 134/39, 40, 42; 252/162, 170, 174.21, 174.23, 542

[56] References Cited

U.S. PATENT DOCUMENTS

| | | | |
|---|---|---|---|
| 3,156,584 | 11/1964 | Yurdin | 134/22.14 |
| 4,120,810 | 10/1978 | Palmer | 252/171 |
| 4,509,989 | 4/1985 | Sumansky | 134/22.14 |
| 4,666,626 | 5/1987 | Francisco | 252/171 |
| 4,732,695 | 3/1988 | Francisco | 252/171 |
| 4,780,235 | 10/1988 | Jackson | 252/171 |

*Primary Examiner*—Paul Lieberman
*Assistant Examiner*—Bradley A. Swope
*Attorney, Agent, or Firm*—Rosenblatt & Associates

[57] ABSTRACT

A solvent system for cleaning coke oven gas lines comprises N-methyl-2-pyrrolidone, aromatic naphtha, and surfactants.

6 Claims, 3 Drawing Sheets

PROCESS FOR DISSOLVING COKE OVEN DEPOSITS COMPRISING ATOMIZING A COMPOSITION CONTAINING N-METHYL-2-PYRROLIDONE INTO THE GAS LINES

This is a continuation of copending application Ser. No. 07/564,895 filed on Aug. 9, 1990, now abandoned.

BACKGROUND OF THE INVENTION

It is well-known that during the operation of coke ovens producing metallurgical coke from coking coal, deposits are formed on the equipment and in the ducts and pipes carrying the effluent gases and vaporized liquids, including tar, light oil, and ammonia liquor. Some of the specific products refined from coke ovens include ammonium sulfate, benzene, toluene, xylene, naphthalene, pyridine, phenanthrene, anthracene, creosote, road tars, roofing pitches and pipeline enamels, along with higher aromatic homologues and many other products. Several hundred individual compounds have been found of saturated and unsaturated aliphatics, aromatics, phenols, amines, and heterofunctional compounds of many types.

A simplified description of the coking process would be the destructive distillation of a complex carbonaceous mineral. The compounds formed or driven off during the process have a wide range of boiling and melting points and solubilities, causing the selective condensation or crystallization of the higher boiling compounds with consequent plugging of transmission lines, poor flow and all of the associated difficulties and dangers associated with this problem.

In particular, the refractory-lined standpipes and goosenecks leading to the horizontal collecting main which conduct the volatile products to the chemical recovery plant are most likely to be plugged by these deposits.

A method of preventing this plugging is thus very desirable. One such method we have found is by the introduction of certain very powerful solvents into the system, which dissolve these deposits and tend to maintain them in the vapor stream.

In general, we have found that solvents with a high Solubility parameter as discussed in Kirk-Othmer's Encyclopedia of Chemical Technology, 3rd Ed., Wiley & Sons, N.Y. 1983, Vol. 21, pp. 377–401 are especially effective. These include N-methyl-2-pyrolidone, N, N-dimethylformamide, 1,4 dioxane, butyrolactone, and other high boiling powerful solvents.

SUMMARY OF THE INVENTION

We have found that a composition comprising certain aprotic solvents is capable of dissolving materials deposited in coke oven piping and transmission lines and thus eliminating the problems caused by plugged lines, and their associated operating difficulties.

In particular we have found that a combination of NMP, an aromatic naphtha, and selected surface active agents is very effective in removing deposits from transmission lines and in keeping these lines clean and free-flowing. The solvents dissolve the deposits.

DETAILED DESCRIPTION OF THE INVENTION

Figure 1:
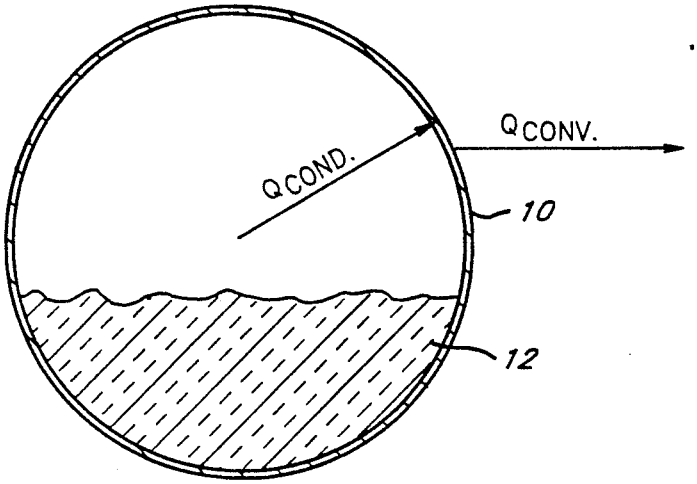
FIG. 1 shows gas pipe 10 with insulating deposits 12. $Q_{cond}$ and $Q_{conv}$ are respectively heat transfer by conduction from gas to pipe surface and heat transfer from the pipe to the environment by a combination of conduction, radiation and convection.
Figure 2:
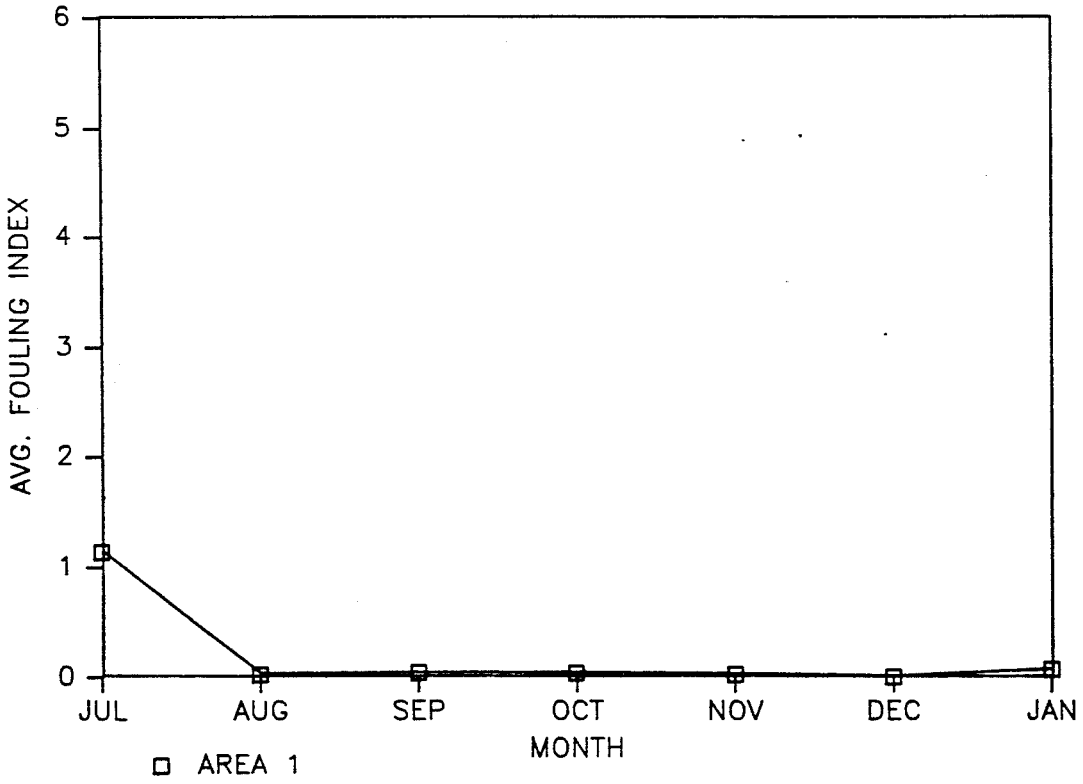
FIGS. 2–6 show the average monthly fouling index for individual areas 1, 2, 3, 6 and 7.
Figure 3:
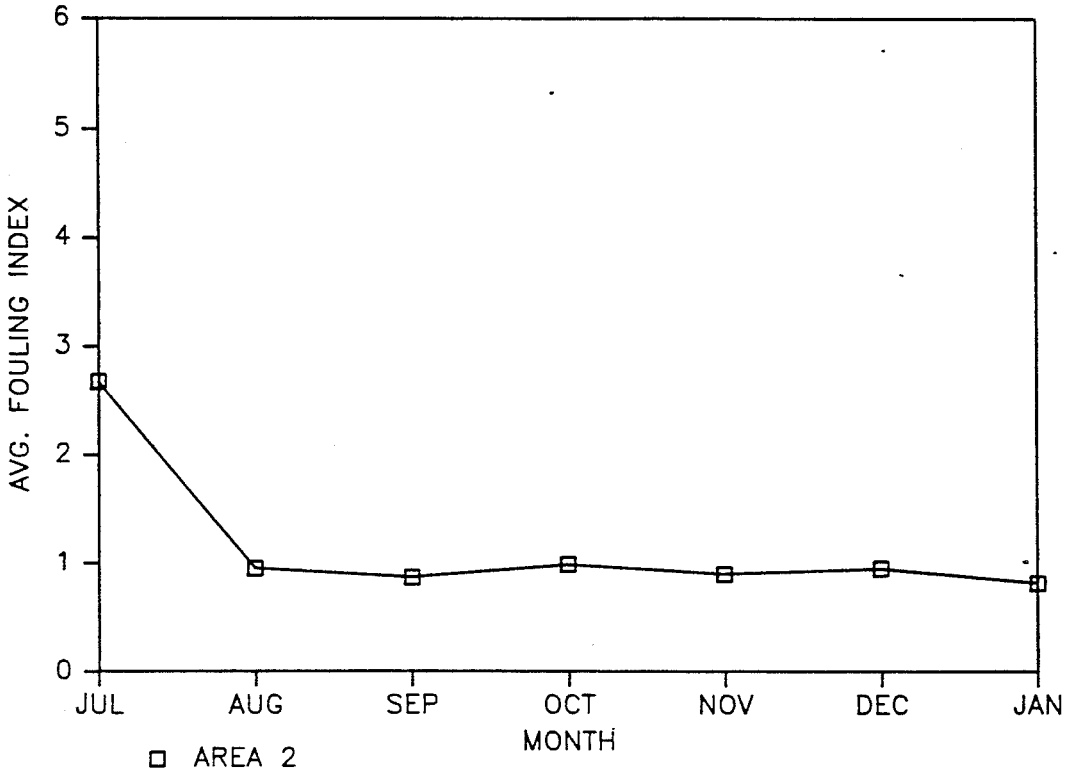
Figure 4:
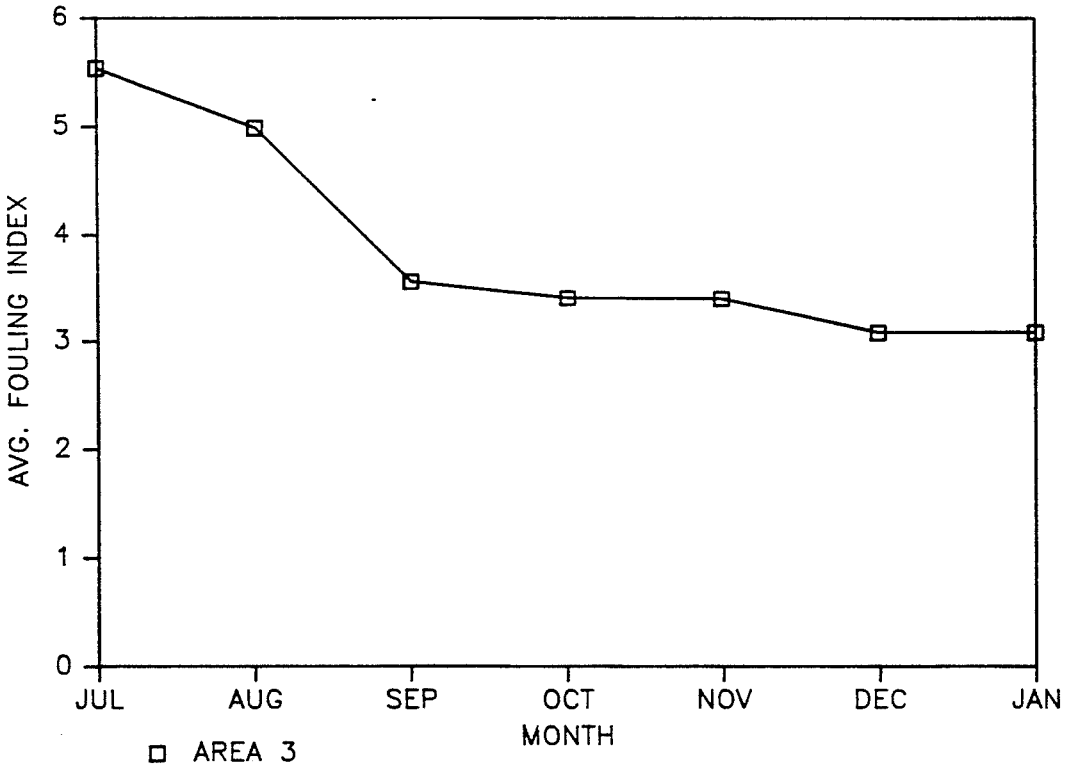
Figure 5:
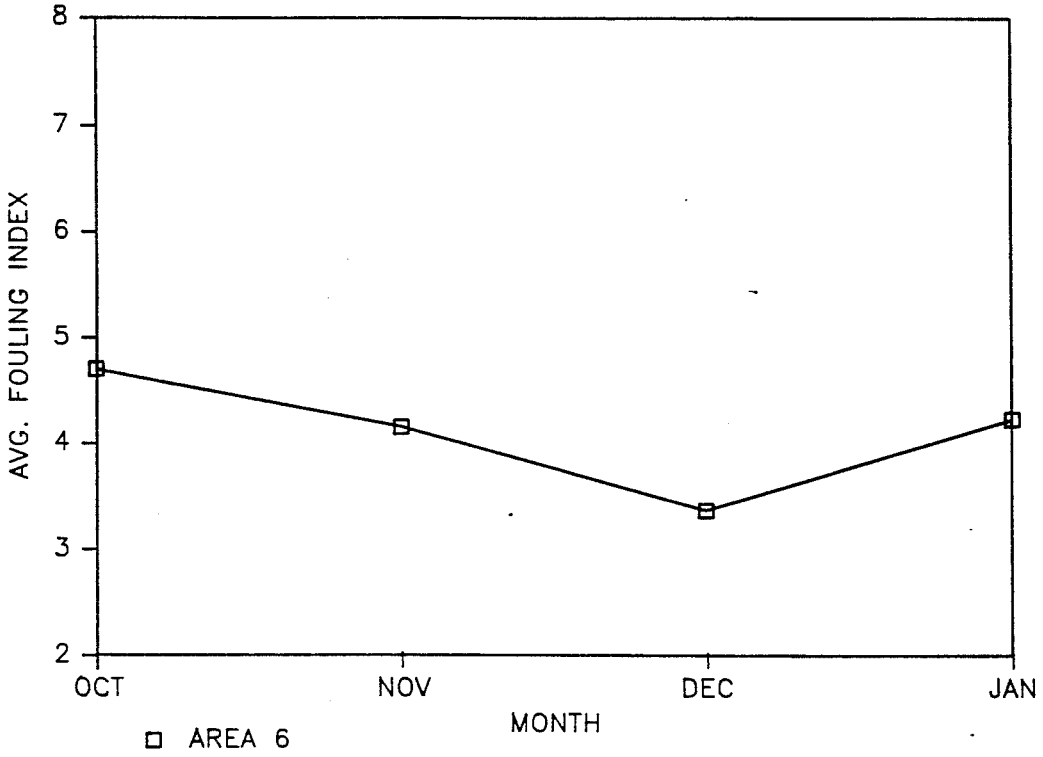
Figure 6:
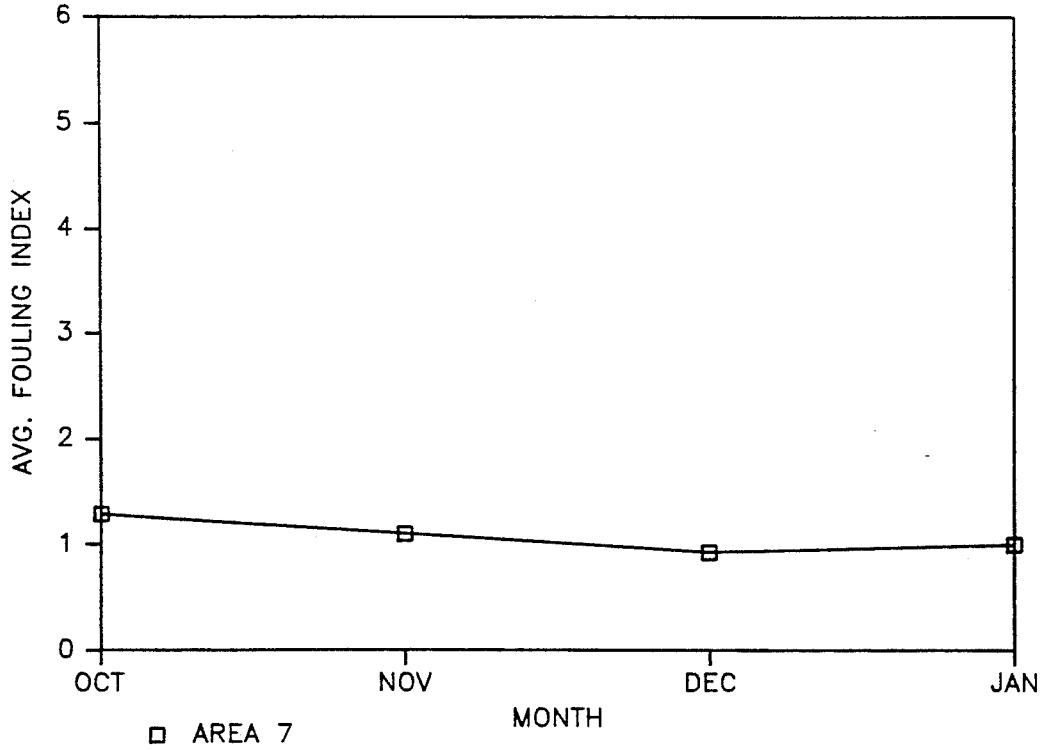

The composition of matter is a blend of active solvent with aromatic naphtha and surfactants comprising as a preferred composition the following:

| | Wt. % |
|---|---|
| N-methyl-2-pyrrolidone | 60–95 |
| High grade HAN (High Aromatic Naphtha, Boiling Range 335° F.–535° F.) | 28–3.5 |
| Nonionic surfactant | 10–1.25 |
| Polymeric dispersant | 2–0.25 |

This solvent when atomized into the gas flow from coke ovens, gradually dissolves the deposits and prevents them from reforming.

A booster exhaust header from the coke oven is particularly prone to fouling. The following describes a fouling index and its derivation.

Since surface temperature and air temperature can be measured, and gas temperature can be estimated, the right hand side of the equation can be calculated. This gives a value for the ratio "U/ ". Since conditions on the outer surface of the gas line are not changing and we have no way to measure wind, " " can be considered constant. With " " constant any change in the ratio $$\frac{\text{"}(T_g - T_a)}{(T_g - T_s)}$$

indicates a change in "U". The value U can be thought of as a thermal conductivity through the deposits in the pipe and the pipe wall. The inverse of the thermal conductivity, U, is thermal resistance.

$$1/U = R \text{ or } U = 1/R \qquad \text{(Equation 1)}$$

where R = thermal resistance:

The thermal resistance is comprised of several factors including the thickness of the pipe wall, the construction material of the pipe, and the thickness of the fouling deposits.

$$R = r$$

where r = the sum of all resisting factors

All of the resisting factors should be constant except for the resistance due to the thickness of deposit. The thickness of deposit should be decreasing, and thus the resistance due to fouling should be decreasing.

$$R = K_r + r_f \text{(Equation 2)}$$

where $K_r$ = constant resistances $r_f$ = resistance due to fouling:

Substituting Equation 2 into Equation 1;

$$U = \frac{1}{K_r + r_f} \qquad \text{(Equation 3)}$$

substituting Equation 3 into $$U = \frac{(T_g - T_s)}{(T_g - T_s)}$$

$$\frac{1}{K_r + r_f} = \frac{(T_g - T_a)}{(T_g - T_s)}$$

Taking the inverse of both sides gives:

$$(K_r + r_f) = \frac{(T_g - T_s)}{(T_g - T_a)}$$

Since " " and "$K_r$" are constant, any change in the ratio $$\frac{(T_g - T_s)}{(T_g - T_a)}$$

is caused by a change in $r_f$, the fouling resistance. But, and $K_r$ can not be measured, so the fouling index has been defined as $$\text{Fouling index} = \frac{(T_g - T_s)}{(T_s - T_a)}$$

Any increase in fouling index indicates increased fouling. Any decrease in fouling index indicates a decrease in fouling.

The attached graphs show the average monthly fouling index for individual areas 1, 2, 3, 6 and 7. Fouling at these areas has been steadily decreasing as indicated by the graphs. Fouling indices were averaged on a monthly basis to eliminate some of the variance in the numbers. The variance most likely occurs for the following two reasons:

1. Gas temperature is estimated. A measured gas temperature would greatly reduce variance.

2. Wind effects are neglected in the convection equation. Wind has a strong influence on convection, but it is difficult to quantify.

We claim:

1. A method for cleaning gas lines in coke oven batteries comprising atomizing a composition into the gas lines of coke oven batteries, where the composition comprises N-methyl-2-pyrrolidone.

2. The method of claim 1 where the composition comprises by wt. 60–95% N-methyl-2-pyrrolidone; 28–3.5% High Aromatic Naphtha; 10–1.25% nonionic surfactant; and 2–0.25% polymeric dispersant.

3. A method for cleaning gas lines in coke oven batteries comprising atomizing a composition into the gas lines of coke oven batteries, where the composition comprises 60–95 wt. % N-methyl-2-pyrrolidone.

4. A method for removing material deposited in coke ovens and coke oven piping and lines comprising contacting the deposited material with a composition comprising N-methyl-2-pyrrolidone; and removing the material with the composition from the coke ovens, coke oven piping and lines.

5. The method of claim 4 where the composition comprises 60–95 wt. % N-methyl-2-pyrrolidone.

6. The method of claim 4 where the composition comprises by wt. 60–95% N-methyl-2-pyrrolidone; 28–3.5% High Aromatic Naphtha; 10–1.25% nonionic surfactant; and 2–0.25% polymeric dispersant.

* * * * *